US010777183B2

(12) United States Patent
Konishi et al.

(10) Patent No.: US 10,777,183 B2
(45) Date of Patent: Sep. 15, 2020

(54) CONTROL APPARATUS, CONTROL SYSTEM, AND CONTROL METHOD

(71) Applicant: Panasonic Intellectual Property Corporation of America, Torrance, CA (US)

(72) Inventors: Kazunobu Konishi, Osaka (JP); Stephen William John, Nara (JP); Katsuhiko Asai, Nara (JP); Ko Mizuno, Osaka (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 0 days.

(21) Appl. No.: 16/147,932

(22) Filed: Oct. 1, 2018

(65) Prior Publication Data

US 2019/0108827 A1 Apr. 11, 2019

Related U.S. Application Data

(60) Provisional application No. 62/569,168, filed on Oct. 6, 2017.

(30) Foreign Application Priority Data

May 30, 2018 (JP) ..... 2018-104095

(51) Int. Cl.
*G10K 11/175* (2006.01)
*G10K 11/178* (2006.01)

(52) U.S. Cl.
CPC ..... *G10K 11/175* (2013.01); *G10K 11/17857* (2018.01); *G10K 11/17873* (2018.01); (Continued)

(58) Field of Classification Search
CPC ..... G10K 11/175; G10K 2210/121; G10K 2210/1281; G10K 11/17873;
(Continued)

(56) References Cited

U.S. PATENT DOCUMENTS 5,834,647 A * 11/1998 Gaudriot ..... G10K 11/178 73/570
9,442,496 B1 * 9/2016 Beckman ..... G10K 11/178
(Continued)

FOREIGN PATENT DOCUMENTS

JP 2017-009965 1/2017

*Primary Examiner* — Jason R Kurr
(74) *Attorney, Agent, or Firm* — Greenblum & Bernstein, P.L.C.

(57) ABSTRACT

A control apparatus, that can expand a range in which noise generated in an unmanned flying object is reduced, is provided. The control apparatus acquires position information of one or more unmanned flying objects and noise information concerning first noises generated by the one or more unmanned flying objects. The control apparatus also acquires output region information indicating an output region of sound output from a speaker. The control apparatus calculates, using the position information, the output region information, and the noise information, second noises that reach the output region. The second noises are caused by the first noises which are generated by the one or more unmanned flying objects. The control apparatus generates opposite phase signals for outputting opposite phase sounds with respect to the calculated second noises, and causes the speaker to output sound on a basis of the generated opposite phase signals.

14 Claims, 4 Drawing Sheets

(52) U.S. Cl.
CPC ..... *G10K 11/17881* (2018.01); *G10K 2210/1281* (2013.01); *G10K 2210/3047* (2013.01); *G10K 2210/3055* (2013.01)

(58) Field of Classification Search
CPC ..... G10K 11/17881; G10K 11/17857; G10K 2210/3055; G10K 2210/3047
See application file for complete search history.

(56) References Cited

U.S. PATENT DOCUMENTS

| | | | | |
|---|---|---|---|---|
| 9,646,597 | B1 * | 5/2017 | Beckman | B64C 39/024 |
| 10,176,792 | B1 * | 1/2019 | Elzinga | G10K 11/175 |
| 2012/0237049 | A1 * | 9/2012 | Brown | G10K 11/178 381/71.1 |
| 2016/0379619 | A1 | 12/2016 | Sugaya | |
| 2017/0061951 | A1 * | 3/2017 | Starobin | H04R 27/00 |
| 2018/0005643 | A1 * | 1/2018 | Tsingos | G10K 11/175 |
| 2018/0204585 | A1 * | 7/2018 | Whittaker | G10L 21/0232 |

* cited by examiner

CONTROL APPARATUS, CONTROL SYSTEM, AND CONTROL METHOD

BACKGROUND

1. Technical Field

The present disclosure relates to a control apparatus, a control system, and a control method for an unmanned flying object.

2. Description of the Related Art

Concerning an unmanned flying object, Japanese Unexamined Patent Application Publication No. 2017-9965 (Patent Literature 1) proposes a wireless aircraft capable of reducing undesired sound while maintaining flying performance of an apparatus body. Specifically, the wireless aircraft described in Patent Literature 1 flies in the air with a rotor blade (a propeller) rotated by a motor. The wireless aircraft described in Patent Literature 1 collects rotation sound of the motor, generates an acoustic wave having an opposite phase of the phase of the collected rotation sound, collects ambient sound, and combines the acoustic wave having the opposite phase of the phase of the collected rotation sound with the collected sound to perform so-called active noise cancelling (ANC).

SUMMARY

For example, a speaker for outputting sound having the opposite phase is mounted on the unmanned flying object. An effect of the ANC is exerted on the periphery of the unmanned flying object. However, there are limits in the magnitude of the output and performance such as directivity of the speaker. It is difficult to exert the effect of the ANC in a wide range.

One non-limiting and exemplary embodiment provides a control apparatus and the like that can expand a range in which undesired sound generated in an unmanned flying object is reduced.

In one general aspect, the techniques disclosed here feature a control apparatus including: a processor; and a memory including at least one set of instructions that, when executed by the processor, causes the processor to perform operations including: acquiring position information of one or more unmanned flying objects and noise information concerning first noises generated by the one or more unmanned flying objects; acquiring output region information indicating an output region of sound output from a speaker; calculating, using the position information, the output region information, and the noise information, second noises that reach the output region, with the second noises being caused by the first noises which are generated by the one or more unmanned flying objects; generating opposite phase signals for outputting opposite phase sounds with respect to the calculated second noises; and causing the speaker to output sound on a basis of the generated opposite phase signals.

With the control apparatus and the like according to the aspect of the present disclosure, a range in which undesired sound generated in the unmanned flying object is reduced can be expanded.

It should be note that these comprehensive and specific aspects may be realized by a system, an apparatus, a method, an integrated circuit, a computer program, or a non-transitory recording medium such as a computer-readable CD-ROM or may be realized by any combination of the system, the apparatus, the method, the integrated circuit, the computer program, and the recording medium.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
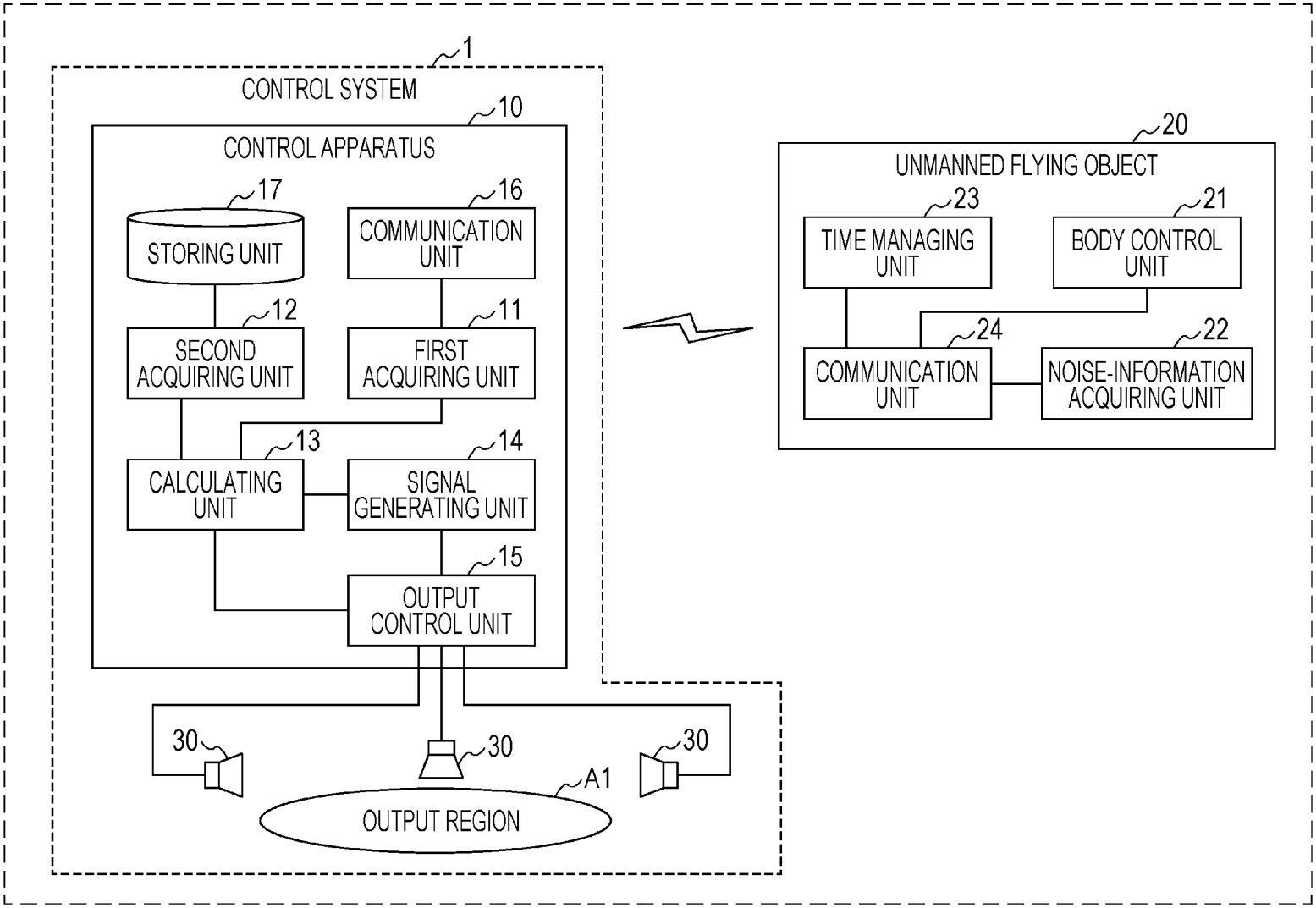
FIG. 1 is a diagram schematically illustrating the configurations of a control system and an unmanned flying object in a first embodiment.

Underlying Knowledge Forming Basis of the Present Disclosure

In recent years, an unmanned flying object represented as a drone, an unmanned aircraft, or a UAV (Unmanned Aerial Vehicle) as well has been started to be used. For example, by flying an unmanned flying object mounted with a camera and a microphone high in the air, photographing and sound collection can be performed in a place where people cannot easily reach. Such an unmanned flying object can be used in, for example, an outdoor event site.

On the other hand, basically, undesired sound generated by the unmanned flying object (mainly undesired sound generated by rotation of a rotor blade) is large. It is desired to reduce the undesired sound. Therefore, for example, it is conceivable to apply a technique (ANC) for collecting undesired sound (a reference signal) generated by the unmanned flying object and reduce the undesired sound.

The ANC is a technique for actively reducing noise such as undesired sound with opposite phase sound. Note that a technique for reducing only undesired sound from sound is also present. For example, undesired sound (a reference signal) is collected and opposite phase sound of the undesired sound is output from a speaker, whereby the undesired sound is reduced. The opposite phase sound of the undesired sound (the reference signal) is sound having an opposite phase to the phase of the undesired sound and is sound having a reversed waveform of a waveform of the undesired sound. Consequently, the sound collected as the undesired sound is reduced.

To apply such ANC, for example, a speaker for outputting sound having an opposite phase is mounted on the unmanned flying object. An effect of the ANC is exerted on the periphery of the unmanned flying object. However, there are limits in the magnitude of the output and performance such as directivity of the speaker. It is difficult to exert the effect of the ANC in a wide range. To cause the speaker to output sound having an opposite phase for reducing undesired sound (noise) in a low-frequency region, the weight of the speaker needs to be increased. This affects flight of the unmanned flying object.

A control apparatus according to an aspect of the present disclosure is a control apparatus including: a processor; and a memory including at least one set of instructions that, when executed by the processor, causes the processor to perform operations including: acquiring position information of one or more unmanned flying objects and noise information concerning first noises generated by the one or more unmanned flying objects; acquiring output region information indicating an output region of sound output from a speaker; calculating, using the position information, the output region information, and the noise information, second noises that reach the output region, with the second noises being caused by the first noises which are generated by the one or more unmanned flying objects; generating opposite phase signals for outputting opposite phase sounds with respect to the calculated second noises; and causing the speaker to output sound on a basis of the generated opposite phase signals.

The first noise generated from the unmanned flying object is, for example, attenuated by space propagation or reflected on a building before the first noise reaches the output region. In the output region, the first noise changes from the first noise at the time of the generation in the unmanned flying object. Therefore, when the output region of the sound output from the speaker and a generation source of the first noise are apart from each other, simply by generating the signal having the opposite phase of the phase of the first noise that is, for example, not attenuated at the time of the generation in the unmanned flying object, even if the sound is output from the speaker on the basis of the signal, the noise cannot be accurately reduced in the output region. On the other hand, according to the present disclosure, the second noise generated from the unmanned flying object and reaching the output region, that is, noise changing from the first noise at the time of the generation in the unmanned flying object is calculated. Therefore, the speaker can be disposed in the periphery of the output region, which is a region where noise is desired to be reduced such as the ground away from the unmanned flying object. Therefore, the speaker may not be mounted on the unmanned flying object. A weight on board of the unmanned flying object can be reduced. When the speaker is not mounted on the unmanned flying object, there is no limit in the weight and the like of the speaker. Therefore, the speaker can be increased in size in order to improve the performance of the speaker. A plurality of speakers can be used. Consequently, a range in which undesired sound can be reduce can be expanded.

Preferably, in the control apparatus of the present disclosure, the operations further include: acquiring time information indicating a generation time of the first noises; calculating, from the position information, the output region information, and the time information, a reaching time of the second noises that reach the output region; and causing the speaker to output the sound on the basis of the generated opposite phase signals according to the calculated reaching time.

It is desirable to synchronize, with arrival of the noise, timing for outputting, with the speaker, the opposite phase sound of the second noise generated in the unmanned flying object and reaching the output region. This is because, if the timing is not synchronized, the noise cannot be reduced or only the opposite phase sound from the speaker is transmitted to the output region, and the opposite phase noise becomes noise to the contrary. On the other hand, according to this aspect, because the reaching time of the second noise reaching the output region is calculated, sound is output from the speaker on the basis of the opposite phase signal according to the reaching time. Therefore, the noise can be accurately reduced according to the arrival of the second noise at the output region.

Preferably, in the control apparatus of the present disclosure, the one or more unmanned flying objects include two or more unmanned flying objects, and the operations further include: calculating the second noises and the reaching time of the second noises for each of the two or more unmanned flying objects; generating the opposite phase signals with respect to the calculated second noises for each of the two or more unmanned flying objects; superimposing the opposite phase signals generated for each of the two or more unmanned flying objects; and causing the speaker to output the sound on a basis of a signal obtained by the superimposing.

The noises respectively generated from the two or more unmanned flying objects and reaching the output region respectively reach the output region. Therefore, the opposite phase signals with respect to the noises are superimposed. The speaker outputs sound based on a signal obtained by the superimposition. Consequently, the noises can be accurately reduced in the output region.

Preferably, in the control apparatus of the present disclosure, the noise information includes a magnitude of the first noises, and the operations further include: calculating a magnitude of the second noises using the position information and the magnitude of the first noises; and causing the speaker to output the sound on the basis of the generated opposite phase signals having a magnitude corresponding to the calculated magnitude of the second noises.

For example, the magnitude (the amplitude) of the first noise generated from the unmanned flying object changes according to space propagation before the first noise reaches the output region. For example, the amplitude of the noise decreases according to propagation attenuation. Therefore, the opposite phase signal for outputting the opposite phase sound having magnitude corresponding to the magnitude of the second noise reaching the output region is generated. Consequently, the noise can be accurately reduced in the output region.

Preferably, in the control apparatus of the present disclosure, the noise information includes a frequency of the first noises, and the operations further include: calculating a frequency of the second noises using the position information and the frequency of the first noises; and generating the opposite phase signals having a frequency corresponding to the calculated frequency of the second noises.

For example, the frequency of the first noise generated from the unmanned flying object changes according to space propagation before the first noise reaches the output region. For example, the frequency of the noise changes according to the movement of the unmanned flying object. Therefore, the opposite phase signal for outputting the opposite phase sound having the frequency of the second noise reaching the output region is generated. Consequently, the noise can be accurately reduced in the output region.

Preferably, in the control apparatus of the present disclosure, the operations further include: acquiring identification information of specific sounds output from one or more second speakers included in the one or more unmanned flying objects; detecting, using the acquired identification information, a signal corresponding to the specific sounds from a signal output from a microphone disposed in the output region; and causing the speaker to output the sound on the basis of the generated opposite phase signals when the signal corresponding to the specific sounds is detected.

The noise (undesired sound) and the specific sound propagate in the space at equal sound speed. Therefore, the first noise generated at the same timing as timing when the specific sound is output from the speaker of the unmanned flying object reaches the output region at the same timing as timing when the specific sound reaches the output region. Therefore, when the signal corresponding to the specific sound is detected (in other words, the timing when the specific sound reaches the output region), sound is output from the speaker disposed around the output region on the basis of the opposite phase signal. Consequently, the noise can be accurately reduced in the output region.

Preferably, in the control apparatus of the present disclosure, the operations further include calculating, using the detected signal corresponding to the specific sounds and the noise information, the second noises that reach the output region.

Consequently, influence on the first noise generated from the unmanned flying object due to space propagation before the noise reaches the output region can be predicted from influence on the specific sound due to space propagation before the specific sound reaches the output region. Therefore, the second noise reaching the output region can be more accurately calculated.

A control system according to an aspect of the present disclosure is a control system including: the above-described control apparatus; and the speaker that outputs the sound to the output region.

Consequently, the range in which undesired sound can be reduced can be expanded. Further, the weight on board of the unmanned flying object can also be reduced.

A control method according to an aspect of the present disclosure is a control method including: acquiring, by a computer, position information of one or more unmanned flying objects and noise information concerning first noises generated by the one or more unmanned flying objects; acquiring, by the computer, output region information indicating an output region of sound output from a speaker; calculating, by the computer, using the position information, the output region information, and the noise information, second noises reaching the output region, with the second noises being caused by the first noises which are generated by the one or more unmanned flying objects; generating, by the computer, opposite phase signals for outputting opposite phase sounds with respect to the calculated second noises; and causing, by the computer, the speaker to output sound on a basis of the generated opposite phase signals.

Consequently, the range in which undesired sound can be reduced can be expanded. Further, the weight on board of the unmanned flying object can also be reduced.

It should be note that these comprehensive and specific aspects may be realized by a system, an apparatus, a method, an integrated circuit, a computer program, or a non-transitory recording medium such as a computer-readable CD-ROM or may be realized by any combination of the system, the apparatus, the method, the integrated circuit, the computer program, and the recording medium.

Embodiments are specifically explained below with reference to the drawings. Note that all of the embodiments explained below indicate comprehensive or specific examples. Numerical values, shapes, materials, components, disposed positions and connection forms of the components, steps, order of the steps, and the like described in the embodiments below are example and are not meant to limit the claims. Among the components in the embodiments, components not described in the independent claims indicating a highest order concept are explained as optional components.

Figures used in the following explanation are schematic diagrams and do not always strictly illustrate disposition, sizes, and the like of the components.

First Embodiment

A first embodiment is explained below with reference to FIGS. 1 to 3.

FIG. 1 is a diagram schematically illustrating the configurations of a control system 1 and an unmanned flying object 20 in the first embodiment.

The unmanned flying object 20 includes, for example, a body control unit 21, a noise-information acquiring unit 22, a time managing unit 23, and a communication unit 24.

The body control unit 21 is a processing unit that controls flight of the unmanned flying object 20. The body control unit 21 includes a GPS (Global Positioning System) or the like for acquiring position information of the unmanned flying object 20 necessary for the control of the flight.

The noise-information acquiring unit 22 acquires noise information concerning first noise generated from the unmanned flying object 20. For example, the noise information includes the magnitude and the frequency of the first noise generated from the unmanned flying object 20. Note that the noise information may include the phase of the first noise. For example, the noise-information acquiring unit 22 acquires noise information including the amplitude (in other words, sound pressure) and the frequency of noise generated from the unmanned flying object 20 collected by a microphone mounted on the unmanned flying object 20. Note that the noise-information acquiring unit 22 may acquire information such as rotating speed of a rotor blades included in the unmanned flying object 20, rotating speed of a motor, and a control command to the unmanned flying object 20 and acquire noise information concerning the first noise specified from these kinds of information. This is because these kinds of information are information correlated to the first noise generated from the unmanned flying object 20 and noise information concerning the first noise generated from the unmanned flying object 20 can be predicted from these kinds of information.

For example, as the rotating speed of the rotor blade (the rotating speed of the motor) increases, the amplitude of noise (wind noise) generated by the rotor blade increases and the frequency of the noise increases. Therefore, for example, by measuring, in advance, noise generated from the rotor blade at each rotating speed of the rotor blade, the rotating speed of the rotor blade and noise information concerning undesired sound generated from the rotor blade can be modeled in advance.

The control command includes a command involving rotation of the rotor blade for, for example, ascending and descending the unmanned flying object 20, moving the unmanned flying object 20 to the front and the rear and the left and the right, and turning the unmanned flying object 20. The control command includes a moving route or speed information in future. Therefore, it is possible to predict from the control command how the rotating speed of the rotor blade fluctuates in future. That is, the control command (a predicted value of the rotating speed of the rotor blade) and noise information concerning undesired sound generated from the rotor blade can be modeled in advance.

The time managing unit 23 has a function of managing time synchronized with the control system 1. That is, time managed in the time managing unit 23 and time managed in the control system 1 indicate the same time each other. The time managing unit 23 acquires time information indicating time at timing when the body control unit 21 acquires position information of the unmanned flying object 20 and time at timing when the noise-information acquiring unit 22 acquires noise information. Note that, for time synchronization of a plurality of systems, a time synchronizing function included in the GPS may be used or a time management server may be set in the control system 1 and a time synchronizing function such as an NTP (Network Time Protocol) may be used.

The communication unit 24 is, for example, a communication interface including an antenna and a transmission and reception circuit for a wireless signal. For example, information is transmitted from the unmanned flying object 20 to the control system 1 (a control apparatus 10 explained below) via the communication unit 24. The communication unit 24 transmits the position information of the unmanned flying object 20 acquired by the body control unit 21, the noise information acquired by the noise-information acquiring unit 22, and the time information acquired by the time managing unit 23 to the control system 1.

The control system 1 includes a control apparatus 10 and one or more speakers 30 that output sounds to an output region A1. The control system 1 includes three speakers 30 disposed to surround the output region A1. Note that the number of the speakers 30 to be disposed is not limited to three and may be any number if the number is one or more. The output region A1 is a region to which the sounds from the speakers 30 are output and is a region where noises (second noises explained below) generated from one or more unmanned flying objects 20 and reaching the region are reduced. For example, the output region A1 is a region on the ground but may be, for example, a region in the air.

The control apparatus 10 is an apparatus for reducing, in the output region A1 of the sounds output from the speakers 30, noises generated from the one or more unmanned flying objects 20 and reaching the output region A1. The configuration of the control apparatus 10 is explained with reference to FIG. 2 as well.

Figure 2:
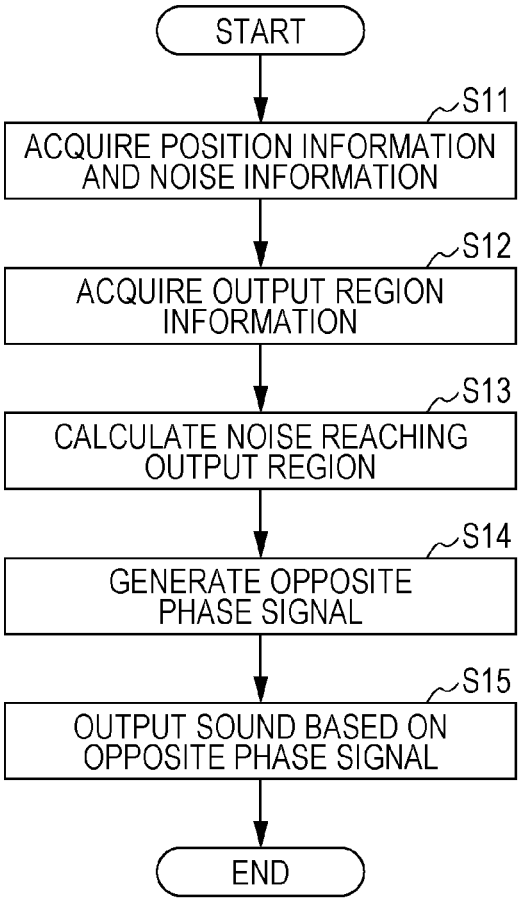
FIG. 2 is a flowchart illustrating an example of the operation of a control apparatus in the first embodiment.

FIG. 2 is a flowchart illustrating an example of the operation of the control apparatus 10 in the first embodiment.

The control apparatus 10 includes a first acquiring unit 11, a second acquiring unit 12, a calculating unit 13, a signal generating unit 14, an output control unit 15, a communication unit 16, and a storing unit 17. The control apparatus 10 is, for example, an apparatus including a processor (a microprocessor), a memory (the storing unit 17), and a communication circuit (the communication unit 16). The communication unit 16 may include an antenna. Note that a memory other than the storing unit 17 may be included in the memory. The memory (the storing unit 17) is a ROM, a RAM, or the like and can store a control program to be executed by the processor. The first acquiring unit 11, the second acquiring unit 12, the calculating unit 13, the signal generating unit 14, and the output control unit 15 are realized by the processor that executes the control program stored in the memory in the control apparatus 10.

The first acquiring unit 11 acquires position information of the one or more unmanned flying objects 20 and noise information concerning the first noise generated from one or more unmanned flying objects 20 (step S11). For example, the first acquiring unit 11 acquires position information and noise information received by the communication unit 16 communicating with the communication unit 24 of the unmanned flying object 20. At this time, the first acquiring unit 11 further acquires time information indicating generation time of the first noise (time when the noise-information acquiring unit 22 acquires the noise information).

The second acquiring unit 12 acquires output region information indicating the output region A1 of sounds output from the speakers 30 (step S12). The output region information specifically includes position information, range information, and the like of the output region A1. For example, the output region information is stored in the storing unit 17 in advance. Note that the communication unit 16 may receive output region information from an external terminal or the like and store the output region information in the storing unit 17 or update the output region information stored in the storing unit 17.

The calculating unit 13 calculates, using the position information, the output region information, and the noise information, second noises reaching the output region A1 in the first noises generated from the one or more unmanned flying objects 20 (step S13). The magnitude (the amplitude) of sound is attenuated according to a distance from a generation source of the sound. An amount of the attenuation can be more easily derived by an experiment or the like or by a publicly-known method or the like. The position of the generation source of the first noise is the position of the unmanned flying object 20 as well. Therefore, the position of the generation source of the first noise is included in the position information of the unmanned flying object 20. A distance from the generation source of the first noise is calculated from the position of the unmanned flying object 20, the position of the output region A1 included in the output region information, and the like. The magnitude of the first noise in the generation source of the first noise is included in the noise information. Therefore, the calculating unit 13 can calculate how much the magnitude (the amplitude) of the first noise (i.e., noise in the position of the unmanned flying object 20) included in the noise information is attenuated before the first noise reaches the output region A1, that is, can calculate the second noise generated from the unmanned flying object 20 and reaching the output region A1. Note that the calculating unit 13 may calculate how much the frequency of the first noise included in the noise information changes before the first noise reaches the output region A1. The calculating unit 13 may calculate a phase of the second noise at a point in time when the second noise reaches the output region A1. For example, a change in the phase of noise is caused by a multipath or the like that occurs, for example, when the noise reflects on an object. Presence or absence or a degree of the change of the phase may be calculated from characteristics (e.g., presence or absence of buildings and heights of the buildings) on a route from the position of the unmanned flying object 20 to the output region A1. Map information and the like may be stored in the storing unit 17 and the like. The calculating unit 13 may calculate the second noise reaching the output region A1 considering the influence (reflection, etc.) of an obstacle or the like present around the output region A1 and the unmanned flying object 20.

The calculating unit 13 calculates, from the position information, the output region information, and the time information, a reaching time of the second noise reaching the output region A1. The reaching time of the second noise can be calculated from generation time of the first noise, the distance between the generation source of the first noise and the output region A1, and sound speed in the air. The generation time of the first noise is included in the time information. The distance between the generation source of the first noise and the output region A1 is calculated from the position of the unmanned flying object 20, the position of the output region A1, and the like. The sound speed in the air is substantially a fixed value of approximately 340 m/s. Therefore, the calculating unit 13 can calculate the reaching time of the second noise reaching the output region A1.

The signal generating unit 14 generates an opposite phase signal for outputting opposite phase sound with respect to the second noise calculated by the calculating unit 13 (step S14). That is, the signal generating unit 14 generates an opposite phase signal for reducing, rather than the first noise generated from the unmanned flying object 20, the second noise that is, for example, attenuated by space propagation before reaching the output region A1. The opposite phase signal is a signal obtained by inverting the amplitude or the like of the second noise calculated by the calculating unit 13.

The output control unit 15 causes the speakers 30 to output sounds on the basis of the opposite phase signal generated by the signal generating unit 14 (step S15). For example, because the reaching time of the second noise reaching the output region A1 is calculated by the calculating unit 13, the output control unit 15 causes the speakers 30 to output the sounds on the basis of the generated opposite phase signal according to the reaching time. The speakers 30 output the sounds toward the output region A1. The sounds are acoustic waves having an opposite phase of the phase of the second noise generated from the unmanned flying object 20 and reaching the output region A1. Therefore, the noise can be reduced in the output region A1.

Note that, in FIG. 1, one unmanned flying object 20 is illustrated as the one or more unmanned flying objects 20. However, the one or more unmanned flying objects 20 may be two or more unmanned flying objects 20. In this case, the first acquiring unit 11 acquires position information of each of the two or more unmanned flying objects 20 and noise information of each of the two or more unmanned flying objects 20. The calculating unit 13 calculates, concerning each of the two or more unmanned flying objects 20, the second noise using the position information, the noise information, and the output region information. The calculating unit 13 calculates a reaching time of the second noise concerning each of the two or more unmanned flying objects 20.

At this time, the signal generating unit 14 generates each of opposite phase signals with respect to each of the calculated second noises and superimposes each of the opposite phase signals according to the calculated reaching time of the second noise. For example, the signal generating unit 14 sets superimposing timing according to reaching times of the noises and superimposes the noises that reach the set timing. The output control unit 15 causes the speakers 30 to output sounds on the basis of the superimposed signals.

In the explanation referring to FIG. 1, the unmanned flying object 20 directly communicates with the control apparatus 10 not via a repeater or the like. However, the unmanned flying object 20 may communicate via the repeater or the like. This is explained with reference to FIG. 3.

Figure 3:
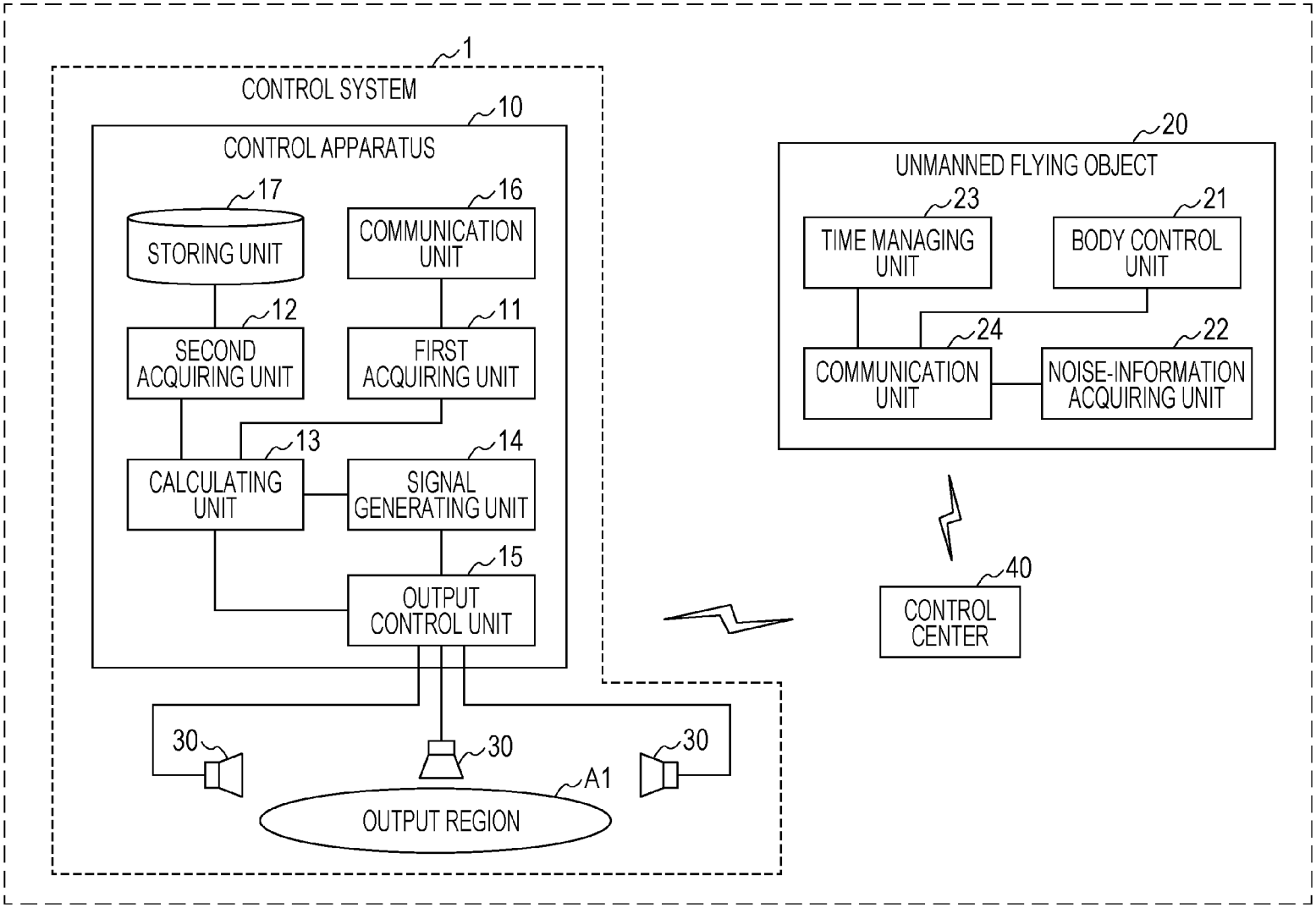
FIG. 3 is a diagram schematically illustrating the configurations of a control system, an unmanned flying object, and a control center in a modification of the first embodiment.

FIG. 3 is a diagram schematically illustrating the configurations of the control system 1, the unmanned flying object 20, and a control center 40 in a modification of the first embodiment. This modification is different from the explanation referring to FIG. 1 in that the control apparatus 10 and the unmanned flying object 20 wirelessly communicate via the control center 40. Otherwise, this modification is the same as the explanation referring to FIG. 1. Therefore, explanation of the similarities is omitted. The difference is mainly explained.

The control center 40 is, for example, a computer that performs management, operation, and the like of the unmanned flying object 20. The control center 40 is capable of wirelessly communicating with the unmanned flying object 20. The control center 40 is capable of communicating with the control apparatus 10 by wire or by radio. For example, the control center 40 generates a control command and transmits the control command to the unmanned flying object 20. The body control unit 21 of the unmanned flying object 20 controls flight of the unmanned flying object 20 on the basis of the control command.

The communication unit 24 transmits the position information of the unmanned flying object 20 acquired by the body control unit 21, the noise information acquired by the noise-information acquiring unit 22, and the time information acquired by the time managing unit 23 to the control center 40. The control center 40 receives these kinds of information and transmits the information to the communication unit 16 of the control apparatus 10.

For example, when the noise-information acquiring unit 22 acquires a control command to the unmanned flying object 20 and acquires noise information concerning the first noise estimated from the control command, because the control command is generated by the control center 40, the control center 40 can estimate the noise information by itself and may not receive the noise information from the unmanned flying object 20. That is, in this case, the unmanned flying object 20 may not include the noise-information acquiring unit 22. When the control center 40 has a function of observing the position of the unmanned flying object 20, the control center 40 may not receive the noise information from the unmanned flying object 20. That is, in this case, the unmanned flying object 20 may not include the GPS. In such a case, the control center 40 can transmit the control command to the unmanned flying object 20 and, at the same time, transmit the position information and the control command (the noise information) to the control apparatus 10 without waiting for the position information and the control command (the noise information) to be received from the unmanned flying object 20. Therefore, an opposite phase signal can be generated beforehand. A processing delay and the like do not need to be considered.

As explained above, the control apparatus 10 includes the first acquiring unit 11 that acquires the position information of the one or more unmanned flying objects 20 and the noise information concerning the first noises generated from the one or more unmanned flying objects 20, the second acquiring unit 12 that acquires the output region information indicating the output region A1 of the sounds output from the speakers 30, the calculating unit 13 that calculates, using the position information, the output region information, and the noise information, the second noises reaching the output region A1 in the first noises generated from the one or more unmanned flying objects 20, the signal generating unit 14 that generates the opposite phase signals for outputting the opposite phase sounds with respect to the calculated second noises, and the output control unit 15 that causes the speakers 30 to output the sounds on the basis of the generated opposite phase signals.

The first noise generated from the unmanned flying object 20 is, for example, attenuated and reflected by space propagation before reaching the output region A1 and, in the output region A1, changes compared with the time of the generation in the unmanned flying object 20. Therefore, when the output region A1 of the sounds output from the speakers 30 and the generation source of the first noise are apart from each other, simply by generating the signal having the opposite phase of the phase of the first noise that is, for example, not attenuated at the time of the generation in the unmanned flying object 20, even if the sounds are output from the speakers 30 on the basis of the signal, the noise cannot be accurately reduced in the output region A1. On the other hand, according to the present disclosure, the second noise generated from the unmanned flying object 20 and reaching the output region A1, that is, noise changing from the first noise at the time of the generation in the unmanned flying object 20 is calculated. Therefore, the speakers 30 can be disposed in the periphery of the output region A1, which is a region where noise is desired to be reduced such as the ground away from the unmanned flying object 20. Therefore, the speakers 30 may not be mounted on the unmanned flying object 20. A weight on board of the unmanned flying object 20 can be reduced. When the speakers 30 are not mounted on the unmanned flying object 20, there is no limit in the weight and the like of the speakers 30. Therefore, the speakers 30 can be increased in size in order to improve the performance of the speakers 30. A plurality of speakers 30 can be used. Consequently, a range in which undesired sound can be reduce can be expanded.

The first acquiring unit 11 may further acquire time information indicating generation time of the first noise. The calculating unit 13 may calculate, from the position information, the output region information, and the time information, a reaching time of the second noise reaching the output region A1. The output control unit 15 may cause the speakers 30 to output sounds on the basis of the generated opposite phase signal according to the calculated reaching time.

Timing when opposite phase sound of the second noise generated in the unmanned flying object 20 and reaching the output region A1 is output by the speakers 30 is desirably synchronized with arrival of the noise. This is because, if the timing is not synchronized, the noise cannot be reduced or only the opposite phase sound from the speakers 30 is transmitted to the output region A1 and the opposite phase noise becomes noise to the contrary. On the other hand, according to this embodiment, because the reaching time of the second noise reaching the output region A1 is calculated, sounds are output from the speakers 30 on the basis of the opposite phase signal according to the reaching time. Therefore, the noise can be accurately reduced according to the arrival of the second noise at the output region A1.

The one or more unmanned flying objects 20 may be two or more unmanned flying objects 20. The calculating unit 13 may calculate the second noise and the reaching time of the second noise concerning each of the two or more unmanned flying objects 20. The signal generating unit 14 may generate each of opposite phase signals with respect to each of the calculated second noises and superimpose each of the opposite phase signals according to each of the calculated reaching times of the second noises. The output control unit 15 may cause the speakers 30 to output sounds on the basis of a signal obtained by the superimposition.

Noises respectively generated from the two or more unmanned flying objects 20 and reaching the output region A1 respectively reach the output region A1. Therefore, the opposite phase signals with respect to the noises are superimposed and the speakers 30 output the sounds based on the signal obtained by the superimposition. Consequently, the noises can be accurately reduced in the output region A1.

The noise information may include the magnitude of the first noise. The calculating unit 13 may calculate the magnitude of the second noise from the position information and the magnitude of the first noise. The output control unit 15 may cause the speakers 30 to output sounds based on the opposite phase signal having magnitude corresponding to the calculated magnitude of the second noise.

For example, the magnitude (the amplitude) of the first noise generated from the unmanned flying object 20 changes according to space propagation before the first noise reaches the output region A1. For example, the amplitude of the noise decreases according to propagation attenuation. Therefore, the opposite phase signal for outputting the opposite phase sound having magnitude corresponding to the magnitude of the second noise reaching the output region A1 is generated. Consequently, the noise can be accurately reduced in the output region A1.

The noise information may include the frequency of the first noise. The calculating unit 13 may calculate the frequency of the second noise from the position information and the frequency of the first noise. The signal generating unit 14 may generate the opposite phase signal having the calculate frequency of the second noise.

For example, the frequency of the first noise generated from the unmanned flying object 20 changes according to space propagation before the first noise reaches the output region A1. For example, the frequency of the noise changes according to the movement of the unmanned flying object 20. Therefore, the opposite phase signal for outputting the opposite phase sound having the frequency of the second noise reaching the output region A1 is generated. Consequently, the noise can be accurately reduced in the output region A1.

The control system 1 includes the control apparatus 10 and the speakers 30 that output sounds to the output region A1.

Consequently, the range in which undesired sound can be reduced can be expanded. Further, the weight on board of the unmanned flying object 20 can be reduced.

Second Embodiment

A second embodiment is explained with reference to FIG. 4.

Figure 4:
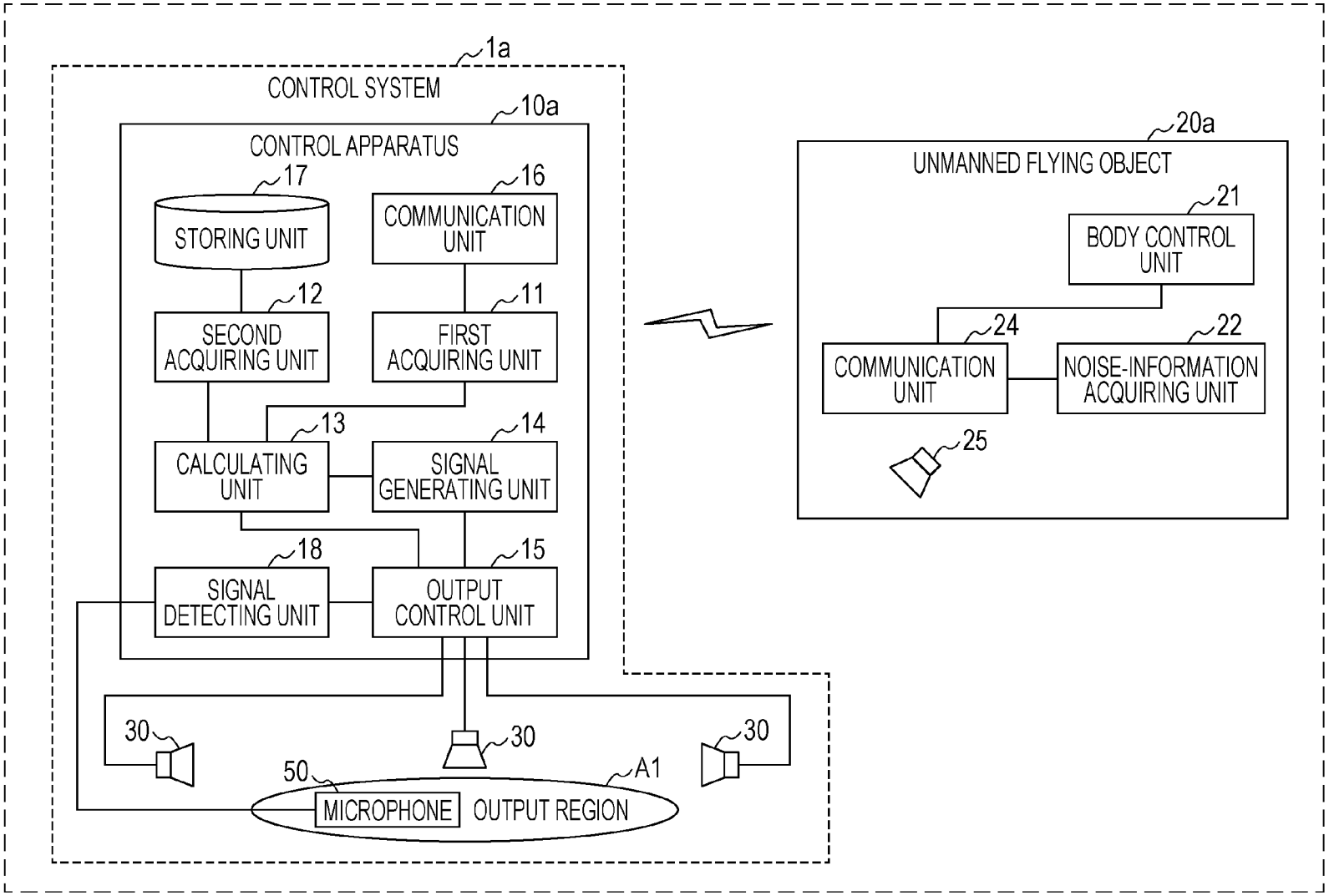
FIG. 4 is a diagram schematically illustrating the configurations of a control system and an unmanned flying object in a second embodiment.

FIG. 4 is a diagram schematically illustrating the configurations of a control system 1*a* and an unmanned flying object 20*a* in the second embodiment.

The unmanned flying object 20*a* is different from the unmanned flying object 20 in the first embodiment in that the unmanned flying object 20*a* does not include the time managing unit 23 and includes a speaker 25. Otherwise, the unmanned flying object 20*a* is the same as the unmanned flying object 20 in the first embodiment. Therefore, the difference is mainly explained.

The unmanned flying object 20*a* includes the speaker 25 that outputs specific sound. The specific sound includes identification information. For example, in a system that includes a microphone and recognizes identification information in advance, when the identification information can be detected from sound collected by the microphone, it can be recognized that the specific sound is included in the collected sound.

The unmanned flying object 20*a* outputs the specific sound from the speaker 25. The communication unit 16 transmits position information, noise information, and identification information to the control system 1*a*.

The control system 1*a* is different from the control system 1 in the first embodiment in that the control system 1*a* includes a control apparatus 10*a* instead of the control apparatus 10 and includes a microphone 50. The control apparatus 10*a* is different from the control apparatus 10 in the first embodiment in that the control apparatus 10*a* further includes a signal detecting unit 18. Otherwise, the control system 1*a* and the control apparatus 10*a* are the same as the control system 1 and the control apparatus 10 in the first embodiment. Therefore, the difference is mainly explained below.

The microphone 50 is disposed in the output region A1 and is capable of collecting sound propagated to the output region A1. Note that a plurality of microphones 50 may be disposed according to the size of the output region A1. The microphone 50 converts the collected sound into an electric signal and outputs the electric signal to the signal detecting unit 18.

The first acquiring unit 11 further acquires identification information of specific sounds respectively output from speakers 25 of one or more unmanned flying objects 20*a*. For example, the first acquiring unit 11 acquires identification information received by the communication unit 16 communicating with the communication unit 24 of the unmanned flying object 20*a*. Note that the identification information may be stored in advance in, for example, the storing unit 17. The first acquiring unit 11 may acquire the identification information from the storing unit 17 or the like.

The signal detecting unit 18 detects, using the identification information acquired by the first acquiring unit 11, a signal corresponding to the specific sound from the signal output from the microphone 50 disposed in the output region A1. The control apparatus 10*a* has acquired the identification information. When the identification information is successfully detected from the sound collected by the microphone 50 as explained above, the control apparatus 10*a* can recognize that the specific sound is included in the collected sound. Consequently, the control apparatus 10*a* can recognize that the specific sound output from the speaker 25 of the unmanned flying object 20*a* reaches the output region A1, that is, can recognize that noise generated from the unmanned flying object 20*a* at timing when the specific sound is output also reaches the output region A1.

When the signal corresponding to the specific sound is detected, the output control unit 15 causes the speakers 30 to output sounds on the basis of an opposite phase signal generated by the signal generating unit 14. In the second embodiment, the unmanned flying object 20*a* does not include the time managing unit 23. A reaching time of the second noise reaching the output region A1 is not calculated by the calculating unit 13. However, time when the signal corresponding to the specific sound corresponds to the reaching time. Therefore, the output control unit 15 causes the speakers 30 to output sounds on the basis of the opposite phase signal according to the time when the signal corresponding to the specific sound is detected. The speakers 30 output the sounds toward the output region A1. As explained in the first embodiment, the sounds are acoustic waves having the opposite phase of the phase of the second noise generated from the unmanned flying object 20*a* and reaching the output region A1. Therefore, the noise can be reduced in the output region A1.

Note that the calculating unit 13 may calculate the second noise reaching the output region A1 using the detected signal corresponding to the specific sound and the noise information. Specifically, the specific sound is, for example, attenuated by space propagation before reaching the output region A1. Sound information including the amplitude and the frequency of the specific sound changes in the output region A1 compared with when the specific sound is generated in the unmanned flying object 20*a*. The signal corresponding to the specific sound detected by the signal detecting unit 18 includes the sound information after the change by the space propagation. Therefore, influence due to the space propagation can be estimated by comparing the sound information of the specific sound when being output from the speaker 25 of the unmanned flying object 20*a* and the sound information after the change by the space propagation. The influence is exerted on the first noise generated from the unmanned flying object 20*a* before the first noise reaches the output region A1. Therefore, the second noise reaching the output region A1 can be more accurately calculated from the estimated influence.

Note that the calculating unit 13 can calculate, without using the position information, the second noise reaching the output region A1 according to the estimated influence. That is, when the calculating unit 13 does not use the position information, the unmanned flying object 20*a* may not include a GPS or the like.

As in the modification of the first embodiment, the control apparatus 10*a* and the unmanned flying object 20*a* may perform wireless communication via the control center 40.

As explained above, the control apparatus 10*a* may further include the signal detecting unit 18. The first acquiring unit 11 may further acquire the identification information of the specific sounds respectively output from the speakers 25 included in the one or more unmanned flying objects 20*a*. The signal detecting unit 18 may detect, using the acquired identification information, the signal corresponding to the specific sound from the signal output from the microphone 50 disposed in the output region A1. The output control unit 15 may cause the speakers 30 to output sounds on the basis of the generated opposite phase signal when the signal corresponding to the specific sound is detected.

Both of the noise (undesired sound) and the specific sound are propagated in the space at equal sound speed. Therefore, the first noise generated at the same timing as timing when the specific sound is output from the speaker 25 of the unmanned flying object 20*a* reaches the output region A1 at the same timing as timing when the specific sound reaches the output region A1. Therefore, when the signal corresponding to the specific sound is detected (in other words, at the timing when the specific sound reaches the output region A1), sounds are output from the speakers 30 disposed around the output region A1 on the basis of the opposite phase signal. Consequently, noise can be surely reduced in the output region A1.

The calculating unit 13 may calculate the second noise reaching the output region A1 using the detected signal corresponding to the specific sound and the noise information.

Influence on the first noise generated from the unmanned flying object 20*a* due to space propagation before the noise reaches the output region A1 can be predicted from influence on the specific sound due to space propagation before the specific sound reaches the output region A1. Therefore, the second noise reaching the output region A1 can be more accurately calculated.

Other Embodiments

The control apparatus and the control system of the present disclosure are explained above on the basis of the embodiments. However, the present disclosure is not limited to the embodiments. Various modifications conceived by those skilled in the art applied to the embodiments and forms constructed by combining constituent elements in different embodiments are also included in the scope of the present disclosure as long as the modifications and the forms do not deviate from the gist of the present disclosure.

For example, the control apparatuses 10 and 10*a* may be realized by a server apparatus or the like. The functional components included in the control apparatuses 10 and 10*a* may be distributed and disposed in a plurality of server apparatuses.

For example, in the embodiments, the first acquiring unit 11 acquires the time information. However, the first acquiring unit 11 may not acquire the time information. This is because, for example, when a communication delay in the wireless communication between the control apparatus 10 and the unmanned flying object 20 is fixed, generation time of the noise information can be calculated from time when the first acquiring unit 11 acquires the noise information and the like.

The present disclosure not only can be realized as the control apparatus and the control system but also can be realized as an information processing method including steps (processing) performed by the components configuring the control apparatus and the control system.

Specifically, as illustrated in FIG. 2, the control method includes acquiring, using a computer, the position information of the one or more unmanned flying objects 20 and the noise information concerning the first noises generated from the one or more unmanned flying objects 20 (step S11), acquiring the output region information indicating the output region A1 of the sounds output from the speakers 30 (step S12), calculating, using the position information, the output region information, and the noise information, the second noises reaching the output region A1 in the first noises generated from the one or more unmanned flying objects 20 (step S13), generating the opposite phase signal for outputting the opposite phase sound with respect to the calculated second noises (step S14), and causing the speakers 30 to output sounds on the basis of the generated opposite phase signal (step S15).

For example, the steps may be executed by a computer (a computer system). The present disclosure can be realized as a computer program for causing the computer to execute the steps included in the method. Further, the present disclosure can be realized as a non-transitory computer-readable recording medium such as a CD-ROM having the computer program recorded therein.

For example, when the present disclosure is realized by the computer program (software), the computer program is executed using hardware resources such as a CPU, a memory, and an input/output circuit of the computer, whereby the steps are executed. That is, the CPU acquires data from the memory, the input/output circuit, or the like and performs an arithmetic operation and outputs an arithmetic operation result to the memory, the input/output circuit, or the like, whereby the steps are executed.

A plurality of components included in the control apparatus and the control system in the embodiments may be respectively realized as dedicated or general-purpose circuits. The components may be realized as one circuit or may be realized as a plurality of circuits.

The plurality of components included in the control apparatus and the control system in the embodiments may be realized as an LSI (Large Scale Integration), which is an integrated circuit (IC). The components may be individually integrated into one chip or may be integrated into one chip to include a part or all of the components. The LSI is sometimes called system LSI, super LSI, or ultra LSI according to a difference in a degree of integration.

The integrated circuit is not limited to the LSI and may be realized by a dedicated circuit or a general-purpose processor. A programmable FPGA (Field Programmable Gate Array) or a reconfigurable processor capable of reconfiguring connection and setting of circuit cells inside the LSI may be used.

Further, if a technique for circuit integration replacing the LSI emerges according to the progress of the semiconductor technique or another technique deriving from the semiconductor technique, naturally, circuit integration of the components included in the control apparatus and the control system may be performed using the technique.

Besides, forms obtained by applying various modifications conceived by those skilled in the art to the embodiments and forms realized by optionally combining the components and the functions in the embodiments within a range not departing from the gist of the present disclosure are also included in the present disclosure.

An aspect of the present disclosure can be used in, for example, a system for reducing noise generated from an unmanned flying object.

What is claimed is:

1. A control apparatus, comprising:

a processor; and a memory including at least one set of instructions that, when executed by the processor, causes the processor to perform operations including:

acquiring position information of two or more unmanned flying objects and noise information, the noise information being initially acquired by and at the two or more unmanned flying objects and concerning first noises generated by each of the two or more unmanned flying objects;

acquiring output region information indicating an output region of sound output from a speaker;

calculating, using the position information, the output region information, and the noise information, second noises that reach the output region and a reaching time of the second noises that reach the output region for each of the two or more unmanned flying objects, the second noises being caused by the first noises which are generated by the two or more unmanned flying objects;

generating opposite phase signals for outputting opposite phase sounds with respect to the calculated second noises for each of the two or more unmanned flying objects;

superimposing the opposite phase signals generated for each of the two or more unmanned flying objects; and causing the speaker to output sound on a basis of the superimposed opposite phase signals.

2. The control apparatus according to claim 1, wherein the operations further include:

acquiring time information indicating a generation time of the first noises; and causing the speaker to output the sound on the basis of the superimposed opposite phase signals according to the calculated reaching time.

3. The control apparatus according to claim 1, wherein the noise information includes a magnitude of the first noises generated by each of the two or more unmanned flying objects, and the operations further include:

calculating a magnitude of each of the second noises using the position information and the magnitude of each of the first noises; and causing the speaker to output the sound on the basis of the superimposed opposite phase signals having a magnitude corresponding to the calculated magnitude of each of the second noises.

4. The control apparatus according to claim 3, wherein the magnitude of each of the second noises is attenuated according to a distance from the two or more unmanned flying objects to the output region.

5. The control apparatus according to claim 1, wherein the noise information includes a frequency of each of the first noises, and the operations further include:

calculating a frequency of each of the second noises using the position information and the frequency of each of the first noises; and generating the opposite phase signals having a frequency corresponding to the calculated frequency of the second noises for each of the two or more unmanned flying objects.

6. A control system comprising:

the control apparatus according to claim 1; and the speaker that outputs the sound to the output region.

7. The control apparatus according to claim 1, wherein the second noises are different than the first noises.

8. The control apparatus according to claim 7, wherein, in the calculating, an influence of an obstacle present around the output region is further used.

9. The control apparatus according to claim 7, wherein, in the calculating, characteristics on routes from positions of the two or more unmanned flying objects to the output region are further used.

10. The control apparatus according to claim 1, wherein the speaker is not mounted on the two or more unmanned flying objects.

11. The control apparatus according to claim 1, wherein the operations further include:

storing map information, the map information including the output region of the sound output from the speaker, wherein, in the calculating, the map information is further used, with an influence of at least one obstacle in the map information being considered.

12. A control apparatus, comprising:

a processor; and a memory including at least one set of instructions that, when executed by the processor, causes the processor to perform operations including:

acquiring position information of one or more unmanned flying objects and noise information, the noise information being initially acquired by and at the one or more unmanned flying objects and concerning first noises generated by the one or more unmanned flying objects;

acquiring output region information indicating an output region of sound output from a speaker;

calculating, using the position information, the output region information, and the noise information, second noises that reach the output region, the second noises being caused by the first noises which are generated by the one or more unmanned flying objects;

generating opposite phase signals for outputting opposite phase sounds with respect to the calculated second noises;

acquiring identification information of specific sounds output from one or more second speakers included in the one or more unmanned flying objects;

detecting, using the acquired identification information, a signal corresponding to the specific sounds from a signal output from a microphone disposed in the output region; and causing the speaker to output sound on a basis of the generated opposite phase signals when the signal corresponding to the specific sounds is detected.

13. The control apparatus according to claim 12, wherein the operations further include calculating, using the detected signal corresponding to the specific sounds and the noise information, the second noises that reach the output region for at least one of the one or more unmanned flying objects.

14. A control method, comprising:

acquiring, by a computer, position information of two or more unmanned flying objects and noise information, the noise information being initially acquired by and at the two or more unmanned flying objects and concerning first noises generated by each of the two or more unmanned flying objects;

acquiring, by the computer, output region information indicating an output region of sound output from a speaker;

calculating, by the computer, using the position information, the output region information, and the noise information, second noises that reach the output region and a reaching time of the second noises that reach the output region for each of the two or more unmanned flying objects, the second noises being caused by the first noises which are generated by the two or more unmanned flying objects;

generating, by the computer, opposite phase signals for outputting opposite phase sounds with respect to the calculated second noises for each of the two or more unmanned flying objects;

superimposing the opposite phase signals generated for each of the two or more unmanned flying objects; and causing, by the computer, the speaker to output sound on a basis of the superimposed opposite phase signals.

* * * * *